United States Patent [19]

Schwarz et al.

[11] Patent Number: 4,715,433

[45] Date of Patent: Dec. 29, 1987

[54] REBOILER-CONDENSER WITH DOUBLY-ENHANCED PLATES

[75] Inventors: Alexander Schwarz, Allentown, Pa.; Charles E. Kalb, East Northport, N.Y.

[73] Assignee: Air Products and Chemicals, Inc., Allentown, Pa.

[21] Appl. No.: 872,299

[22] Filed: Jun. 9, 1986

[51] Int. Cl.[4] ..... F28F 3/04; F28F 3/12; F28D 9/02

[52] U.S. Cl. ..... 165/110; 165/166; 165/911; 165/913; 165/133; 62/36; 62/42

[58] Field of Search ..... 165/111, 166, 110, 911, 165/913, 133; 62/285, 288, 42, 36

[56] References Cited

U.S. PATENT DOCUMENTS

| | | | |
|---|---|---|---|
| Re. 30,077 | 8/1979 | Kun et al. | 165/133 |
| 3,204,693 | 9/1965 | Kuhn | 165/145 X |
| 3,359,616 | 12/1967 | Butt | 29/157.3 |
| 3,568,462 | 3/1971 | Hoffman et al. | 165/166 X |
| 3,631,923 | 1/1972 | Izeki | 165/167 |
| 3,720,071 | 3/1973 | Nasser et al. | 62/42 |
| 3,840,070 | 10/1974 | Becker et al. | 165/167 |
| 4,060,125 | 11/1977 | Fujie | 165/133 |
| 4,130,160 | 12/1978 | Dziedzic et al. | 165/166 |
| 4,150,719 | 4/1979 | Theilen et al. | 165/166 X |
| 4,153,501 | 5/1979 | Fink et al. | 165/166 X |
| 4,216,826 | 8/1980 | Fujikaki | 165/133 |
| 4,371,034 | 2/1983 | Yamada et al. | 165/100 |
| 4,383,415 | 5/1983 | Jacob | 62/288 X |
| 4,606,745 | 8/1986 | Fujita | 165/166 |
| 4,653,572 | 3/1987 | Bennett et al. | 165/1 |

FOREIGN PATENT DOCUMENTS

| | | | |
|---|---|---|---|
| 123949 | 7/1931 | Austria | 165/111 |
| 541415 | 10/1955 | Belgium | 165/166 |
| 1081592 | 5/1960 | Fed. Rep. of Germany | 165/166 |
| 3011011 | 9/1980 | Fed. Rep. of Germany | 174/99 B |
| 551167 | 2/1943 | United Kingdom | 165/166 |
| 2090651 | 7/1982 | United Kingdom | 33/455 |
| 252362 | 2/1970 | U.S.S.R. | 165/111 |
| 1035398 | 8/1983 | U.S.S.R. | 137/343 |
| 1092331 | 5/1984 | U.S.S.R. | 165/166 |

OTHER PUBLICATIONS

Webb, R. L., "The Evolution of Enhanced Surface Geometries for Nucleate Boiling," Heat Transfer Engineering 2, (Nos. 3-4), pp. 46-69, 1981.

Panchal et al., "Analysis of Nusselt-Type Condensation on a Vertical Fluted Surface," Numerical Heat Transfer 3, pp. 357-371, (1980).

Rohsenow, W. M., "Boiling", Handbook of Heat Transfer Fundamentals, pp. 12-1 to 12-9, (1973).

*Primary Examiner*—Albert W. Davis, Jr.
*Assistant Examiner*—John K. Ford
*Attorney, Agent, or Firm*—Willard Jones, II; James C. Simmons; William F. Marsh

[57] ABSTRACT

The invention is a reboiler-condenser which increases the efficiency of heat transfer between boiling and condensing fluids, such as oxygen and nitrogen in air separation or similar cryogenic applications. The exchanger is built up from individual plates, the opposite sides of which have enhanced condensing and boiling surfaces. The condensing channels are inclined slightly downward so that condensate can be removed at many elevations in the exchanger.

12 Claims, 10 Drawing Figures

REBOILER-CONDENSER WITH DOUBLY-ENHANCED PLATES

TECHNICAL FIELD

The present invention relates to a heat exchanger for reboiler-condenser service in cryogenic and chemical fractionation processes.

BACKGROUND OF THE INVENTION

Two designs of heat exchanger are presently in general use for reboiler-condensers in air separation and similar cryogenic, and chemical applications. The most common of these is the plate-fin brazed aluminum heat exchanger fabricated by disposing corrugated aluminum sheets between parting sheets to form a plurality of fluid passages.

The second type of heat exchanger in current use is a vertical shell and tube reboiler. To achieve a sufficiently low temperature difference with this design, enhanced surfaces are used. A porous boiling surface is applied to the inside of the tubes, and longitudinal flutes are used on the outside of the tubes. The disadvantages of the shell and tube design are the limited heat transfer surface which can be accommodated in a distillation column and the high cost of construction of the heat exchanger. In addition, this type of exchanger is subject to accumulation of thick liquid condensate films in the lower regions of the exchanger.

A third type of exchanger which is believed to have seen some application for reboiler-condensers in cryogenic separation plants and which is available commercially in the "BAVEX" type exchanger. This configuration is described in U.S. Pat. No. 3,720,071. Specially corrugated sheets are juxtaposed to define passages for the boiling oxygen and the condensing nitrogen. This exchanger is apparently also subject to the build-up of thick condensate films, since various attempts are described to put ribs, projections, and the like, on the condensing side of the corrugated sheets to remove the condensate from the sheets. The exchanger is intended to operate with boiling in the conventional manner from the plain metal surface of the corrugated sheets.

Russian Pat. No. 1,035,398 describes a plate type reboiler-condenser. The condensing passages have perforated corrugated inserts and inclined channels machined into the plates which are intended to drain condensate to the sides of the exchanger. The boiling passages have ribbed projections on the plates, additionally covered with a porous enhanced boiling surface.

U.S. Pat. No. 4,371,034 describes a plate type evaporator with an enhanced porous surface applied to the boiling side. The boiling liquid is recirculated in thermosyphon fashion. Since the heating medium can be a condensing stream, the proposed heat exchanger can be used as a reboiler-condenser. The heat exchanger is a combination of an enhanced boiling surface on the plates of a conventional exchanger of the plate type. The gasketed construction is unsuitable for cryogenic service. No enhancement is proposed for the hot, i.e. condensing, side of the exchanger.

West German Pat. No. 3,011,011 describes a plate type reboiler-condenser for air separation service, where individually extruded plates are stacked and brazed together to form vertical boiling and condensing channels with small rectangular cross sections. Voids in the extruded plates comprise the condensing channels, and longitudinal thick ribs on the plates comprise fins in the boiling passage. These fins are much thicker than those used in conventional plate-fin brazed aluminum exchangers. The boiling channels defined between the ribs of the extrusions do not communicate with one another and could pose a safety problem if even one of the small channels were to be inadvertently closed off and permit dry boiling to occur. Putting an enhanced boiling surface on the ribbed side of the plates is disclosed; however, no enhancement is provided on the condensing side.

SUMMARY OF THE INVENTION

The present invention is a heat exchanger for reboiler or condenser service which comprises a plurality of plates of a thermally conductive material; with these plates having on opposite sides of each plate an enhanced condensing surface and an enhanced boiling surface, respectively. These sheets are assembled in a stack, with the enhanced condensing surfaces of each pair of plates facing the enhanced condensing surface of its neighbor and the enhanced boiling surfaces of each pair of plates facing the enhanced boiling surface of its neighbor, with a plurality of interposing support bars, thereby defining between successive plates respective flow passages. The support bars between plates with the enhanced condensing surfaces facing each other being inclined from horizontal thereby defining downward sloping condensing channels and the support bars between plates with the enhanced boiling surfaces facing each other being vertical thereby defining vertical boiling channels. The support bars and plates are joined together by any suitable means, e.g. brazing. End bars are provided for closing edges between alternating pairs of plates wherein the enhanced condensing surfaces face each other, and side bars are provided for closing vertical edges between alternating pairs of plates wherein the enhanced boiling surfaces face each other.

DETAILED DESCRIPTION OF THE INVENTION

In the operation of a cryogenic air separation plant of the generally used double column design, the power consumption of the air compressor is directly related to the temperature difference between the oxygen being reboiled in the low-pressure column and the nitrogen being condensed in the high-pressure column. Reduction of the temperature difference across this reboiler-condenser will permit reduction of the power consumption for the production of oxygen and nitrogen. Typically, a reduction of one degree Fahrenheit in the temperature difference will permit a reduction of about 2% in air compression power and a reduction of about 1% in the cost of producing oxygen gas. It is also important that the reboiler-condenser equipment should be compact and preferably able to fit entirely within the distillation column.

Thus the purpose of the apparatus of the present invention is to help reduce both the power cost and capital cost associated with the air separation process. Similar benefits may be obtained in other processes where a reduction of heat transfer temperature difference in a compact device is of value. This applies especially in the cryogenic process industry; for example in the processing of natural gas, hydrogen, helium and other gases where the cleanliness of the system permits the use of compact heat exchange equipment.

Figure 1:
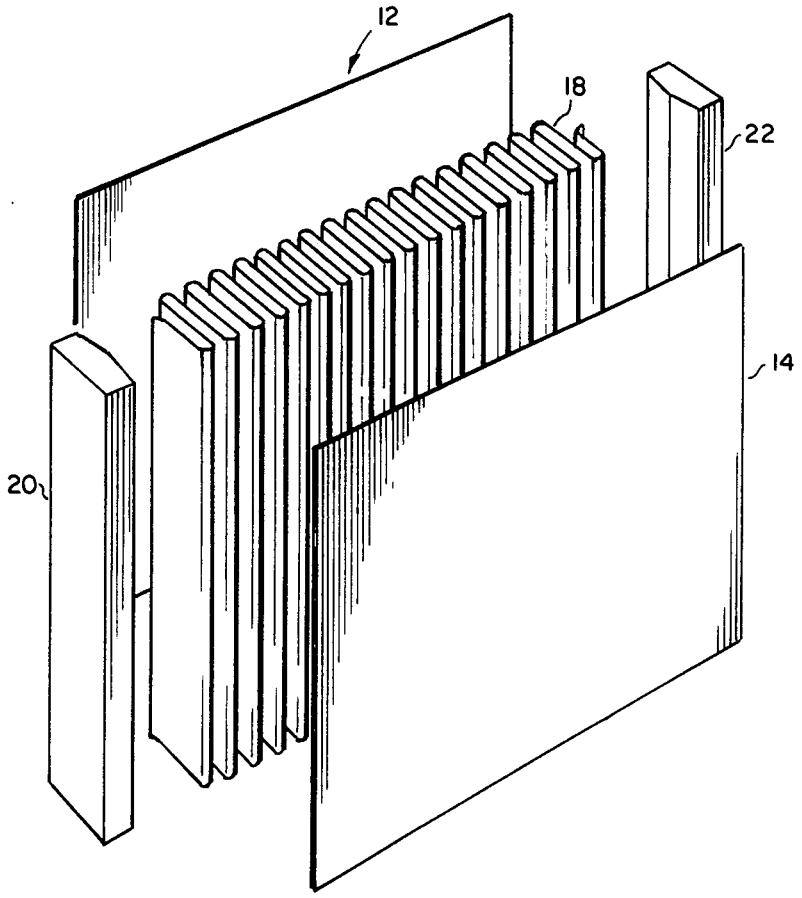
FIG. 1 PRIOR ART
FIG. 1 is an exploded perspective view of a basic element of a conventional plate-fin brazed heat exchanger.
Figure 2:
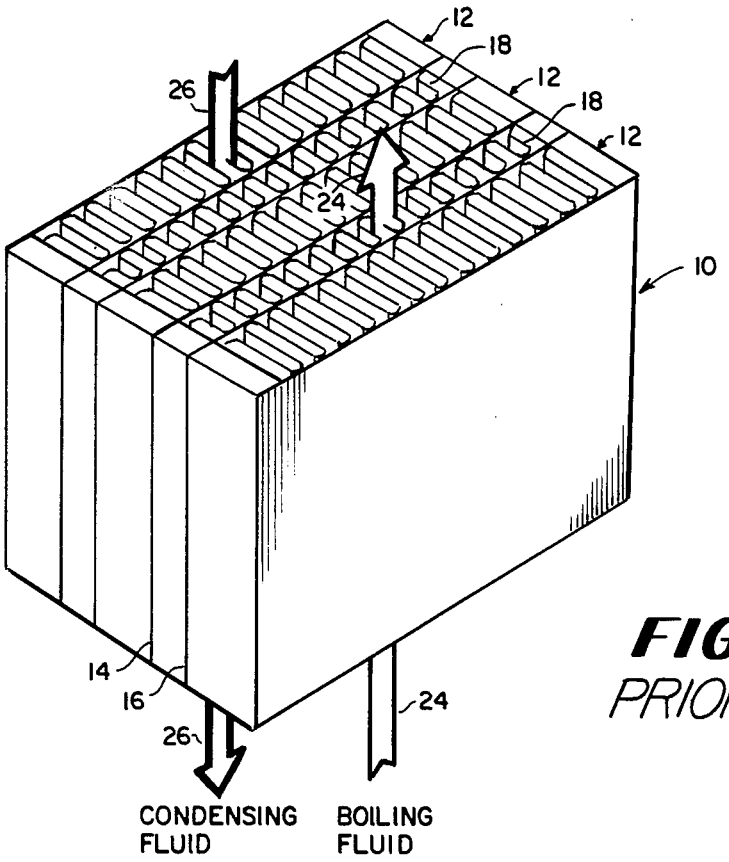
FIG. 2 PRIOR ART
FIG. 2 is a perspective detailing the flow passages in a conventional plate-fin heat exchanger.

A typical heat exchanger 10, of the plate-fin type, is shown in FIG. 2. Heat exchanger 10 consists of a plurality of sub-assemblies 12 (FIG. 1) comprised of aluminum parting sheets 14 and 16, normally 0.03 to 0.05 inches thick, which are disposed on either side of corrugated aluminum sheet 18 which serves to form a series of fins perpendicular to the parting sheets. Typically, the fin sheet 18 will have a thickness of 0.008 to 0.012 inches with 15 to 25 fins per inch and a fin height (distance between parting sheets) of 0.2 to 0.3 inches. Each sub-assembly 12 is formed by brazing together two parting sheets 14 and 16 spaced apart by a fin sheet 18 with the edges enclosed by side bars 20 and 22, as shown in FIG. 1. A complete heat exchanger 10 is assembled by brazing together a plurality of sub-assemblies 12 spaced apart by corrugated sheets such as 18.

Figure 3:
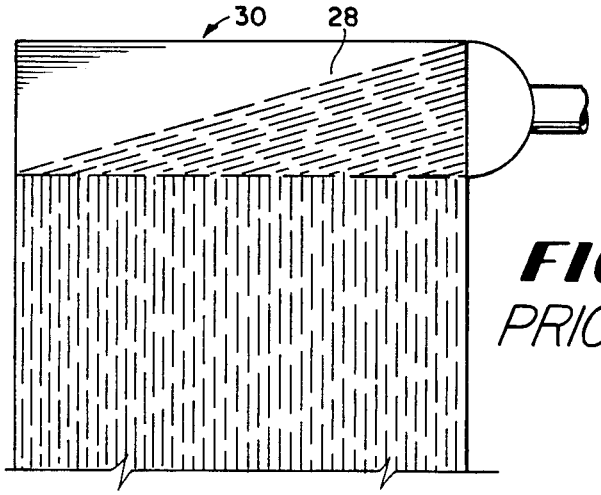
FIG. 3 PRIOR ART
FIG. 3 is a diagram detailing the side header and distributor fin for the condensing passages in a conventional plate-fin heat exchanger.

The exchanger 10 (FIG. 2) is immersed in a bath of the liquid to be boiled with the parting sheets, e.g. 14 and 16, and the fins, e.g. 18, orientated vertically. Alternate passages separated by the parting sheets contain the boiling and condensing fluids. The liquid to be boiled enters the open bottom of the boiling passages and flows upward under thermosyphon action, as shown by arrow 24. The resulting heated mixture of liquid and vapor exits via the open top of the boiling passages. The vapor to be condensed is introduced at the top of the condensing passages through a manifold welded to the side of the heat exchanger and having openings into alternate passages. The resulting condensate leaves the lower end of the condensing passages through a similar side manifold, as shown by arrow 26. Special distributor fins 28, inclined at an angle to vertical in header 30, are used at the inlet and outlet of the condensing passages, as illustrated in FIG. 3. The upper and lower horizontal ends of the condensing passages are sealed with end bars (not shown), as is known in the prior art.

The present invention is a reboiler-condenser especially useful in increasing the efficiency of heat transfer between boiling and condensing fluids such as oxygen and nitrogen in air separation plants. The exchanger of the present invention is constructed from four types of parts—doubly-enhanced plates, support bars, end bars, and side bars.

One side of each plate is specially fabricated to enhance condensation, and the other side to enhance nucleate boiling. It is not the intent of this invention to specify the exact configuration of the enhanced condensing and boiling surfaces. Any of the surface configurations known in the art as being effective for enhancing condensation or boiling can be applied to the plates. Such surfaces can be formed integrally from the base metal of the plates or be applied as a separate layer. The present invention is directed at an improved reboiler-condenser of especial usefulness in cryogenic processes.

Figure 4:
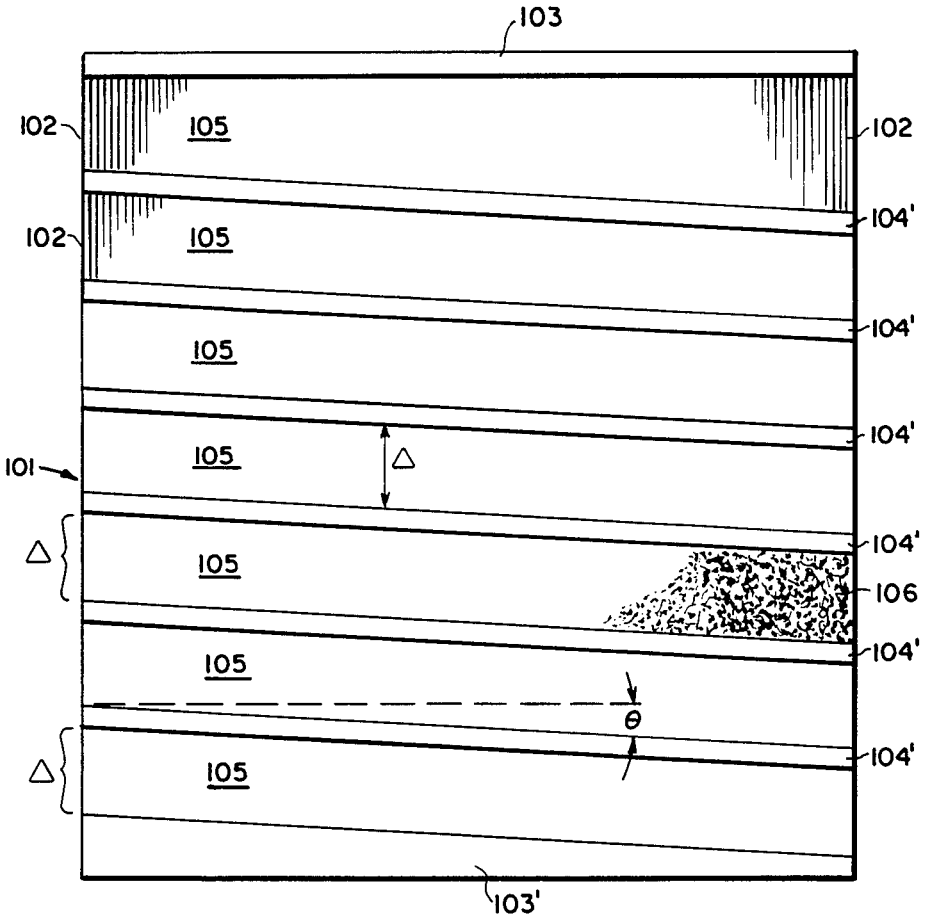
FIG. 4 is a diagram detailing the condensation side of a doubly-enhanced plate of the present invention and illustrating two types of condensing surfaces which can be applied to the condensing side surface.

The condensation side of the doubly-enhanced plate 101 is shown in FIG. 4. Bands 102 of fins or flutes are rolled or machined into the condensing-side surface of the plate 101. Generally, flat bare areas 103' and 104' are left on the plates where end bars 103 and support bars 104, respectively (FIG. 8), will be placed. Support bars 104 could be made of a hollow structure with openings on one side shown as support bar 220 in FIG. 8 wherein condensate enters through perforations 222 located on the top of support bar 220 and ultimately drains through opening 224. These openings would face upward and would allow for drainage of condensed liquid through the hollow structure. This configuration would add efficiency to the exchanger. These flat bare areas are inclined slightly from the horizontal at an angle $\Theta$, the preferred value of which is in the range of 2 to 20 degrees. These flat bare areas with the associated end and support bars define downward-sloping individual condensing channels 105. Vapor to be condensed would enter at the left-hand side of the plate shown in FIG. 4, and condensate would leave at the right-hand side. The lower bare space 103' should be shaped to accommodate an end bar with a sloped upper surface, so that condensate is forced to drain to the right in the lowermost condensing channel 105.

The orientation of the fins or flutes 102 on the plate 101 is preferably vertical so that condensate can drain vertically downwards as quickly as possible in the valleys between the fins or flutes 102. Alternatively, it might be easier to fabricate the fins or flutes exactly perpendicular to the bare areas 104'. In this case the fins or flutes would be inclined from vertical by the angle $\Theta$. Once the condensate has drained to the bottom of each valley it will combine with other condensate and drain along the sloping top surfaces or in the interior of the support bars placed in bare areas 104' to the right side of the plate shown in FIG. 4.

The vertical spacing distance $\Delta$ between the flat bare areas 104' is chosen small enouguh to provide adequate strength to withstand the design pressure on the condensing side of the exchanger, as well as to provide support for the plates during the assembly brazing operation. Moreover, the vertical distance $\Delta$ determines the magnitude of the condensing-side enhancement, as will be described later in this application. In general, the average condensing heat transfer coefficient will increase as $\Delta$ is made smaller. However, there are practical limits on the degree to which $\Delta$ can be decreased in attempting to increase the condensing heat transfer coefficient, since decreasing the spacing $\Delta$ entails trading enhanced condensing surface for additional support bars.

Fins or flutes are known to enhance condensation through the action of surface tension forces which thin the condensate films on and near the crests of the fins or flutes. This enhancement mechanism is disclosed, for example, in Panchal, C. B and K. J. Bell, "Analysis of Nusselt-Type Condensation on a Vertical Fluted Surface," Numerical Heat Transfer 3, 357–371 (1980) and in other sources known in the heat transfer art. There are other enhancement mechanisms for condensation besides fins or flutes. For example, U.S. Pat. No. 4,216,819 describes a method whereby randomly distributed metal bodies are bonded to a heat transfer wall. Surface tension forces and film thinning are also behind the success of this method. Such a surface of a similar one, applied as a layer, is illustrated schematically as banded region 106 in FIG. 4. Banded region 106 is an option to banded region 102; in any case, all condensing channels 105 would have an enhanced surface.

Figure 5:
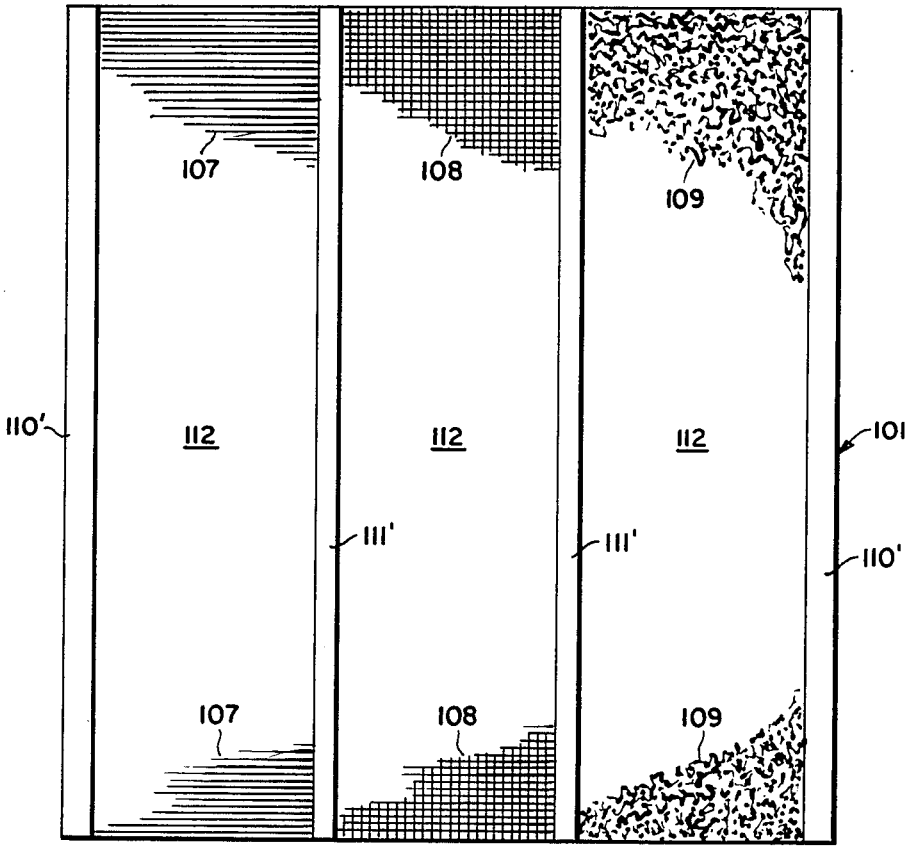
FIG. 5 is a diagram detailing the boiling side of a doubly-enhanced plate of the present invention and illustrating three types of boiling surfaces which can be applied to the boiling side surface.

The boiling side of the doubly-enhanced plate 101 is shown in FIG. 5. Vertical bands of enhanced boiling surface extend from the top to the bottom of this side of the plate. Three types of enhanced boiling surface are illustrated, although only one would normally be used in a given heat exchanger. The enhanced boiling surfaces are formed integrally from the base metal of the plates or applied as a separate layer. Such enhanced boiling surfaces which can be added as a thin layer include sintered porous metal layers, flame sprayed or plasma sprayed surfaces, and others.

In FIG. 5, banded region 107 illustrates an enhanced boiling surface the elements of which are primarily unidirectional. Although such unidirectional elements may be inclined at any angle from the horizontal (zero to 90 degrees), the preferred orientation is horizontal, so that bubble sites will remain trapped on the surface and not tend to rise vertically with the ascending boiling liquid. Such stable bubble nucleation sites are known to be required for the nucleate boiling process. Unidirectional surface 107 may be formed by rolling fins or flutes into the surface or by machining grooves to form these projections. The resulting unidirectional fins or flutes would not be particularly effective for boiling a liquid since they would likely transfer heat by a less efficient convective vaporization mechanism rather than by nucleate boiling. To be effective at promoting nucleate boiling, the fins or flutes would have to be modified by a subsequent manufacturing step to form the subsurface re-entrant cavities known to be needed in the nucleate boiling process.

Below are three ways in which the unidirectional fins or flutes could be subsequently modified to produce a surface which would be effective at promoting nucleate boiling.

The unidirectional fins or flutes can be bent to one side so that the crest of each fin or flute almost touches the side of an adjoining fin or flute. This technique, when practiced on externally finned tubing, as described in Webb, R. L., "The Evolution of Enhanced Surface Geometries for Nucleate Boiling," Heat Transfer Engineering 2 (Nos. 3–4), 46–69 (1981), is known to increase pool boiling heat transfer coefficients by as much as a factor of 10 compared with the unbent fins. The key to success of this method is to form longitudinal gaps between bent fins or flutes which are smaller than the interior width of the so-formed subsurface grooves. Such re-entrant grooves provide stable sites for bubble nucleation, the vapor so formed leaving at various points along the narrow gap between adjoining fins or flutes.

Figure 6A:
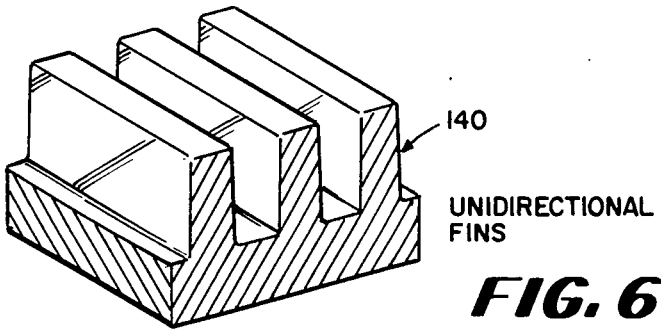
FIG. 6A is a schematic of a fin or fluted type surface for the boiling side surface.
Figure 6B:
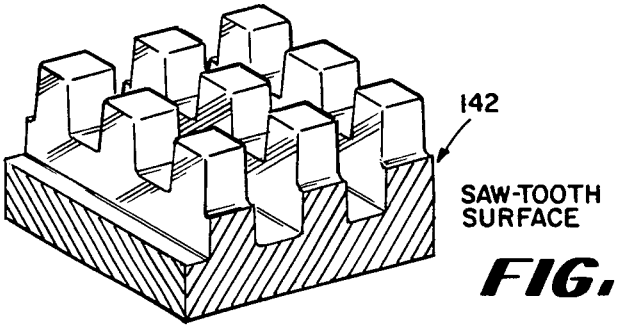
FIG. 6B is a schematic of a saw-tooth type surface for the boiling side surface.

Referring to FIGS. 6A and 6B, these unidirectional fins or flutes 140 can be machined with a cutting tool at approximately right angles to the fins or flutes to produce the saw-tooth type surface 142, as illustrated. If the saw-tooth projections are then bent or rolled over to one side so that they touch the adjoining projections, an enhanced boiling surface having openings to subsurface grooves is formed that is similar to that produced commercially by Hitachi on the outside of round tubes (Thermoexcel-E TM), as is described in U.S. Pat. No. 4,060,125.

Figure 7:
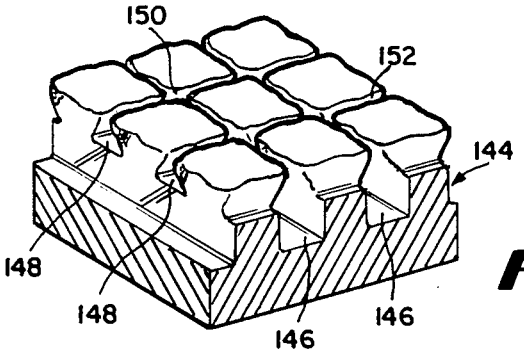
FIG. 7 is a schematic of a boiling surface formed by partially crushing the saw-tooth peaks.

If the saw-tooth type projections are partially crushed in a rolling operation instead of being bent to one side, the enhanced boiling surface 144 illustrated schematically in FIG. 7 can be produced. As illustrated in FIG. 7, surface 144 has a labyrinth of subsurface interconnected channels 146 and 148 with re-entrant grooves 150 and 152 opening into the boiling passage. Such surfaces greatly increase nucleate boiling compared with flat surfaces. The boiling surface shown is a variation of one which has been patented for application to the outside of tubing, U.S. Pat. No. 4,216,826.

Banded region 108 in FIG. 5 illustrates an enhanced boiling surface the elements of which are primarily bidirectional. For example, such a surface could be formed by cross scoring the plates with a cutting tool as is described in U.S. Pat. No. Re. 30,077. The surface depicted in FIG. 7 is another example of one with bidirectional elements. Banded region 109 in FIG. 5 illustrates an enhanced boiling surface of the type which would be applied as a separate layer (e.g. sintered porous surface, plasma sprayed surface, etc.).

Flat bare areas 110' and 111' are left on the boiling side of the plate where side bars 110 and support bars 111, respectively, will be placed. These side and support bars when in place define vertical boiling channels 112. Liquid to be boiled would enter at the bottom of the plate shown in FIG. 5 and flow vertically upwards under the action of thermosyphon forces. A partially vaporized stream would then leave the boiling channels 112 at the upper end of the plate.

In the following description, reference is made to the use of the reboiler-condenser of the present invention in an air separation facility. Such reference is intended to point out the preferred utility; however, the present invention can be used in any utility where such a heat exchange service is required.

Figure 8:
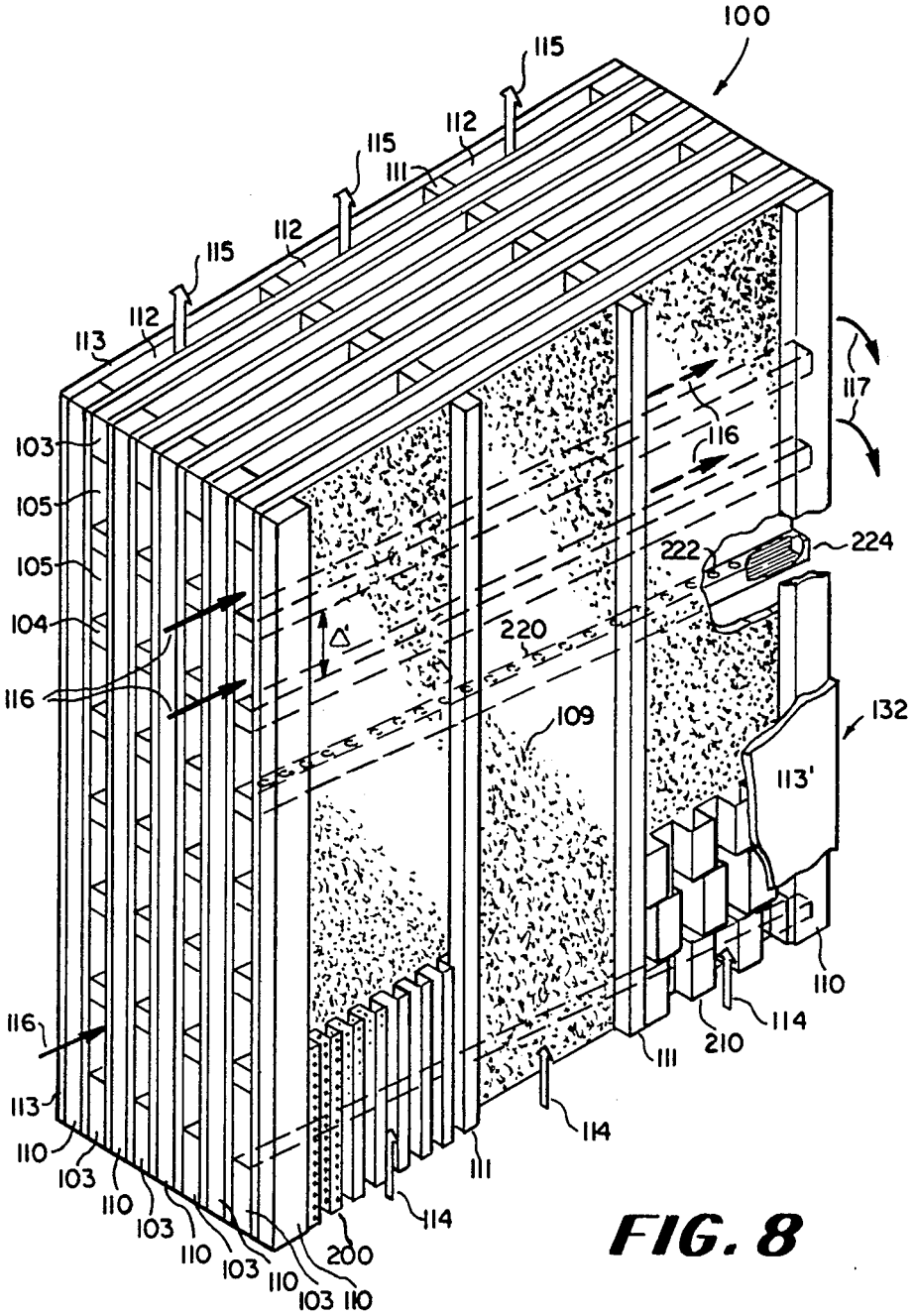
FIG. 8 is a partial perspective of the reboiler-condenser of the present invention.

FIG. 8 shows a method of assembly of the enhanced reboiler-condenser or exchanger 100. For purposes of illustration, five boiling passages and four condensing passages are shown. It should be made clear that the total number of alternating boiling and condensing passages and the overall dimensions of the exchanger will depend on the total heat exchange required in a given application, the dimensions of the doubly-enhanced plates, the performance of the enhanced boiling and condensing surfaces for the fluids being used, and other engineering factors normally invoked during the design of reboiler-condensers. For the exchanger design illustrated in FIG. 8, the two outermost boiling passages are closed off with plain metal plates 113, 113'. A substantial portion of plate 113' has been removed so that the internal details of the boiling passages may be illustrated. Also, the header arrangements for the boiling and condensing streams have been omitted for clarity.

Such details can vary from application to application and are not considered essential to the invention.

The exchanger 100 is preferably constructed of aluminum and brazed as one completed assembly in a vacuum brazing furnace. Other metals such as stainless steel can also be used. Headers can be welded on to the assembly after the vacuum brazing operation. The exchanger 100 is immersed in a bath of the liquid to be boiled, with the boiling channels 112 orientated vertically. For purposes of illustration, FIG. 8 shows an enhanced boiling surface 109 applied as a layer. However, other types of enhanced boiling surfaces such as those represented by regions 107 and 108 in FIG. 5 could be used in place of surface 109.

The reboiler-condenser 100 depicted in FIG. 8 implies that the number of boiling passages exceeds the number of condensing passages by one. An alternative exchanger configuration is achieved by making the two outermost passages condensing passages. In this instance, the number of condensing passages exceeds the number of boiling passages by one.

Although not shown explicitly in FIG. 8 because of the scale of the drawing, the downwardly sloping condensing channels 105 have banded regions of fins or flutes such as are shown in 102 in FIG. 4 to enhance heat transfer on the condensation side of the exchanger 100.

The boiling channels 112 are open at the top and bottom of the exchanger 100, and the transverse space available for flow of the boiling fluid is determined by the thickness of side bars 110 and internal support bars 111 in the boiling passages. The support bars 111 are required during the brazing operation, since the exchanger would likely be positioned in the brazing oven with the condensing and boiling passages stacked horizontally. The support bars 111 possibly could be eliminated entirely, giving completely open boiling passages, if the method of brazing heat exchangers with open passages disclosed in U.S. Pat. No. 3,359,616 is practiced. Alternatively, holes could be drilled through the support bars to allow the boiling fluid to redistribute in a direction perpendicular to support bars 111.

Liquid oxygen to be boiled enters the open boiling channels 112 at the bottom of the exchanger, as represented by arrows 114. The boiling oxygen flows upwards under the action of thermosyphon forces, and a partially vaporized mixture leaves the open boiling channels 112 at the top of the exchanger, as represented by arrows 115. More liquid is circulated by the thermosyphon action than can be vaporized in one pass through the boiling passages. The vaporized oxygen disengages from the gas/liquid mixture 115 immediately above the exchanger, and the excess circulated liquid falls back into the pool of liquid oxygen in which the exchanger is immersed. For the particular application of boiling liquid oxygen in an air separation facility, it is particularly important, for safety considerations, to provide sufficient excess liquid oxygen circulation through the boiling passages. The excess liquid ensures that all surfaces in the boiling passages are wetted, thus avoiding dry boiling and the risk of solid hydrocarbon accumulation and explosion. Because the boiling passages of the present invention are free of the closely spaced fins used in conventional plate-fin brazed aluminum reboiler-condensers, the boiling-side fluid experiences less flow resistance. Therefore, under similar thermosyphon conditions, the present invention will result in substantially larger liquid circulation rates.

The gaseous nitrogen to be condensed enters the condensing channels 105 at the inlet side of the condensing passages (left-hand side of FIG. 8), as represented by arrows 116. The resulting nitrogen condensate leaves at the lower end of the condensing channels 105 (right-hand side of FIG. 8), as represented by arrows 117. Noncondensable gases, if present in the inlet gaseous nitrogen 116, will tend to accumulate at the discharge end of the condensing passages. Noncondensable gases are deleterious to the condensation heat transfer process if allowed to accumulate. These gases can be purged from the system through a vent valve located exterior to the exchanger in the vapor space at the discharge of the condensing passages.

It should be emphasized that the slightly inclined (2 to 20 degree inclination) condensing channels 105 and the finned or fluted surface therein are one of the key aspects of the present invention. Condensation heat transfer within the condensing channels 105 is enhanced by two mechanisms not present in conventional plate-fin brazed aluminum reboiler-condensers. Firstly, the small fins or flutes on those portions of the condensing channels 105 which are not completely flooded by condensate will provide localized sites near the crests of these protuberances where the surface tension mechanism mentioned earlier will significantly increase condensing heat transfer coefficients. Secondly, the slightly inclined and nearly horizontal orientation of each condensing channel 105, itself, will lead to significantly larger condensing heat transfer coefficients, as explained below.

Classical Nusselt theory for condensation of a vapor on a vertical surface predicts that the average heat transfer coefficient for a vertical surface is inversely proportional to the one-fourth power of the total height of the vertical surface. This decrease in the average heat transfer coefficient with increasing vertical height is a result of the increasing thickness of the condensate film as the film progressively moves down the vertical surface. Condensate forms because the latent heat of vaporization is removed from the vapor. Once formed, the condensate only presents an increasing resistance to further heat transfer. Conventional plate-fin brazed aluminum reboiler-condensers in air separation plants typically are approximately 10 inches high. This means that condensate films formed at the entrance to the condensing passages at the top of a conventional plate-fin exchanger must travel downwards the entire vertical height of the exchanger, about 100 inches, increasing the resistance to condensation heat transfer at all lower elevations in the exchanger. This is true of the condensate formed at all elevations in the exchanger, since all of the condensate exits at the bottom in this type of exchanger.

In contrast, the present invention provides for numerous points of condensate removal at the outlet end of every condensing channel 105. The vertical height $\Delta'$ of the condensing channel 105 in FIG. 8 typically might be on the order of about two inches. Condensate will form principally on the side walls of each condensing channel 105 and drain vertically downward, until it reaches the bottom portion of each channel where it will join with other condensate formed in the higher inclined portion of that same channel. All of the condensate formed in a given condensing channel 105 eventually exits as stream 117 at the outlet of the condensing passages. Because the condensate drains in the bottom of the condensing channels 105, most of the vertical side walls of these channels will be unflooded and available for condensing heat transfer. Although an exact analysis is not possible because of the complicated nature of the heat transfer and fluid flow processes, the classical Nusselt theory can be used to estimate the approximate advantage of the present invention over the condensation heat transfer in conventional plate-fin brazed aluminum reboiler-condensers. Since the effective vertical height for condensation in the present invention can be assumed about two inches rather than 100 inches in the conventional exchanger, the average condensing heat transfer coefficient in the present invention is expected to be larger by a factor of about $(100/2.0)^{\frac{1}{4}}$, or 2.66, than the average coefficient in the conventional exchanger. This is an increase of 166%. The increase in the average condensing heat transfer coefficient for other values of the vertical spacing Δ' are given in Table I.

TABLE I

| Vertical Spacing Δ': Inches | Expected Enhancement in Condensation Heat Transfer Coefficient: % Increase in Average Condensation Heat Transfer Coefficient* |
|---|---|
| 1 | 216 |
| 2 | 166 |
| 3 | 140 |
| 4 | 124 |
| 5 | 111 |
| 6 | 102 |
| 12 | 70 |

*Relative to a 100" high conventional plate-fin brazed aluminum reboiler-condenser.

Specific recommendations are not made here for various dimensions, parameters, etc., of enhanced boiling surfaces or the fins/flutes intended to enhance the condensation heat transfer process inside the condensing channels 105. It is known that such dimensions and parameters may have optimal values which depend on the physical properties of the fluids being used and, therefore, are application dependent. Criteria for designing enhanced boiling or condensing surfaces are available to one skilled in the art, once the application and fluids are chosen.

Figure 9:
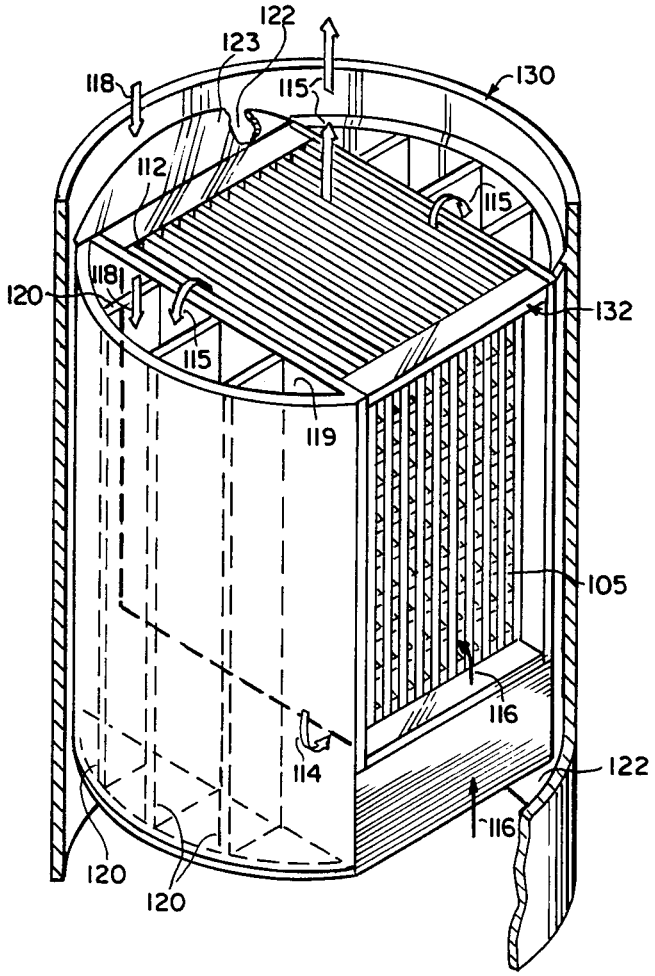
FIG. 9 is a cut-away perspective of the heat exchanger of the present invention as disposed in a double column distillation unit.

FIG. 9 shows how the proposed reboiler-condenser 132 could be mounted within the double column 130 of an air separation plant. The exchanger 132 is positioned in the sump of the low-pressure column and physically separates the high-pressure and low-pressure columns. Liquid oxygen arrow 118 from the bottom tray of the low-pressure column falls into the sump. This liquid oxygen combines with liquid oxygen disengaging from the partially vaporized oxygen stream arrow 115 at the top of the open boiling channels 112 and flows downwards through partitioned regions 119. Vertical parallel plates 120 divide the two oxygen-side segmental spaces between the exchanger and the walls of the low-pressure column into partitioned regions 119. Liquid oxygen stream arrow 114 then enters the open boiling channels 112 at the bottom of the exchanger. If desired, a liquid oxygen product stream could be withdrawn through a pipe, not shown, and a gaseous oxygen product stream could be withdrawn from the vapor space above the exchanger.

The two nitrogen-side segmental spaces 122 between the exchanger and the walls of the high-pressure column are isolated from the low-pressure column by two segmental plates 123. Nitrogen vapor arrow 116 rises from the top tray of the high-pressure column and enters the inlet side of the inclined condensing channels 105. Nitrogen condensate leaves at the lower end of the inclined passages, not shown. The collected nitrogen condensate leaves through a pipe, not shown, and is returned as reflux to the high-pressure column. If desired, a liquid nitrogen product can also be withdrawn through a pipe, not shown. If desired, a gaseous nitrogen product can be withdrawn through a pipe, not shown. Noncondensible components of the vapor, if present, can be withdrawn through a pipe, not shown.

It is known that a liquid to be boiled in thermosyphon fashion does not begin boiling immediately at the entrance to the boiling passages. This is because the liquid is somewhat subcooled at that point because of the imposed hydrostatic head of liquid. This means that there will be a region at the lower end of the boiling passages where heat is transferred only by convection. Therefore, a variation of the exchanger shown in FIG. 8 suggests itself, whereby conventional corrugated fin (of the perforated or serrated type as shown as fins 200 and 210, respectively, in FIG. 8) is placed in the lower approximately 10 to 30% of the boiling channels 112 to significantly speed up the rate of heating of the liquid so that this nonboiling region can be made as small as possible. In this case, the enhanced boiling surface could be omitted in this lower region of the boiling passages.

Although the present improved reboiler-condenser has been described in terms of thermosyphon boiling, the invention will provide the same advantages when the boiling-side fluid is circulated by forced flow rather than by thermosyphon action.

The proposed enhanced reboiler-condenser increases the efficiency of heat transfer between boiling and condensing fluids through several mechanisms. The improved efficiency results in a substantial reduction of temperature difference at a given heat flux. In the case of an air separation plant, the power and capital costs associated with the air compressor can be reduced. Improvements in compactness of the exchanger and oxygen safety are also obtained.

The distinguishing features of the invention are as follows:

Enhanced condensing and boiling heat transfer surfaces are produced on the opposite sides of a plate, leaving bare spaces for side bars, end bars and support bars. By stacking these doubly-enhanced plates and simple parts in the manner described earlier and brazing in a vacuum oven, an enhanced reboiler-condenser core can be manufactured.

The condensing channels are inclined downwards slightly from horizontal (2 to 20 degrees). This permits withdrawal of condensate at many elevations in the exchanger, eliminating a serious shortcoming of the prior art heat exchangers. This enhancement alone could result in improvement of as much as about 200% in condensing heat transfer coefficients, as estimated in Table I.

Both the condensing and boiling channels are free of the closely spaced fins used in conventional plate-fin reboiler-condensers. This leads to lower inherent pressure drop on both sides of the present exchanger. Besides being more efficient, energy wise, the lower frictional resistance in the boiling passage results in a larger circulation rate of excess liquid oxygen through the passages, giving an inherently safer exchanger.

Because the boiling passages are completely open, except as interrupted by any support bars which may be needed, the boiling fluid is free to redistribute within the boiling passages. This is a distinct advantage in preventing the possibility of dry boiling of oxygen. Moreover, holes can be drilled in the support bars, allowing adjacent boiling channels to communicate transversely. This would further contribute to providing a safe environment for the boiling of oxygen.

Disadvantages of the plate-fin brazed aluminum heat exchanger which are overcome by the present invention are:

(a) The two phase boiling stream cannot easily redistribute in a direction perpendicular to its flow.

(b) A very close fin spacing is required in both the boiling and condensing passages to obtain enough secondary heat transfer surface and still result in a heat exchanger volume which will fit within the distillation column. The closely spaced fins present considerable resistance to flow and may result in a relatively low liquid/vapor flow ratio at the outlet of the boiling passages and high pressure drop losses in the condensing passages. The higher pressure drop losses in the boiling passages result in an unfavorable change in the boiling vapor pressure equilibrium curve increasing the overall top-end temperature difference between the boiling and condensing fluids and, correspondingly, decreasing the efficiency of the reboiler-condenser.

(c) Liquid condensate films, which begin to form at the top of the condensing passages, must travel downwards over the entire height of the heat exchanger. Because the objective is generally to totally condense the warming stream (nitrogen in the case of an air separation plant), the condensate films get progressively thicker as they approach the lower end of the condensing passages, causing the condensation heat transfer process to be progressively hindered in the lower regions of the condensing passages. This in turn hinders the overall heat transfer process and contributes to a significant temperature difference between the condensing and boiling fluids necessary to transfer the desired amount of heat.

(d) The finned boiling passages are not amenable to incorporation of enhanced boiling surfaces. Boiling in the finned passages occurs through the process of convective vaporization at the surface of liquid films, since the temperature differentials between the plain metal parting sheets and fins and the boiling fluid are generally too small to support the more efficient nucleate boiling process which produces bubbles of vapor at the liquid/metal interface. In contrast, it is known that enhanced boiling surfaces, such as applied porous metal layers and machined or otherwise deformed metal surfaces which comprise subsurface re-entrant cavities and which are known in the art, are very effective at promoting the nucleate boiling heat transfer mechanism. It is especially significant that these enhanced boiling surfaces are effective even at very small temperature differentials between the surface and the boiling fluid, an attribute which makes them particularly attractive for reducing the power and capital costs associated with the air separation process.

Items (a) and (b) above are especially significant when considering operating safety in an air separation plant, where it is especially important to avoid dry boiling which could cause accumulation of solid hydrocarbons (present in minute amounts as impurities) and consequent risk of explosion.

The spirit of the invention does not preclude other methods of forming an enhanced boiling surface. The present invention has been described with reference to a preferred embodiment thereof. However, this embodiment should not be considered a limitation on the scope of the invention, which scope should be ascertained by the following claims.

We claim:

1. A heat exchanger for reboiler-condenser service which comprises: a plurality of plates of a thermally conductive material; with said plates having substantially horizontal and vertical edges and, on opposite sides of each plate, means for condensate film thinning and means for promoting boiling, respectively; said sheets assembled in a stack, with the means for condensate film thinning of each pair of plates facing each other and the means for promoting boiling of each pair of plates facing each other, with a plurality of interposing support bars, thereby defining between successive plates respective flow passages; said support bars between each pair of plates with the means for condensate film thinning facing each other extending between the vertical edges of each said pair of plates and being inclined from horizontal thereby defining downward sloping condensing channels and providing a primary means for drainage of condensate, and said support bars between each pair of plates with the means for promoting boiling facing each other being vertical thereby defining vertical boiling channels; means for joining said support bars and plates; first means for closing the horizontal edges between alternating pairs of plates with the means for condensate film thinning facing each other; and second means for closing vertical edges between alternating pairs of plates with the means for promoting boiling facing each other.

2. The heat exchanger of claim 1 which further comprises a conventional corrugated fin sheet located in the lower 10 to 30% of the boiling channels.

3. The heat exchanger of claim 2 wherein said conventional corrugated fin sheet is of the perforated type.

4. The heat exchanger of claim 2 wherein said conventional corrugated fin sheet is of the serrated type.

5. The heat exchanger of claim 1 wherein said downward sloping condensing channels are at an angle of 2° to 20° from horizontal.

6. The heat exchanger of claim 1 wherein the means for promoting boiling is a sintered porous surface.

7. The heat exchanger of claim 1 wherein the means for promoting boiling is a plasma sprayed surface.

8. The heat exchanger of claim 1 wherein the means for promoting boiling is a partially crushed saw-tooth surface.

9. The heat exchanger of claim 1 wherein the means for condensate film thinning is a finned or fluted surface with said fins or flutes oriented vertically.

10. The heat exchanger of claim 1 wherein the means for condensate film thinning is a finned or fluted surface with said fins or flutes at an angle of 2° to 20° from vertical.

11. The heat exchanger of claim 1 wherein the means for condensate film thinning is comprised of randomly distributed metal bodies applied as a layer.

12. The heat exchanger of claim 1 wherein said support bars between pairs of plates with the means for condensate film thinning facing each other are hollow with perforations on the upward side of said support bar, thereby allowing for drainage of condensate from the condensing channels.

* * * * *